US009450295B2

(12) United States Patent
Tsai et al.

(10) Patent No.: US 9,450,295 B2
(45) Date of Patent: Sep. 20, 2016

(54) WIRELESS COMMUNICATION DEVICE

(71) Applicant: FIH (Hong Kong) Limited, Kowloon (HK)

(72) Inventors: Chih-Yang Tsai, Shindian (TW); Hao-Ying Chang, Shindian (TW); Chuan-Chou Chi, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 201 days.

(21) Appl. No.: 14/057,124

(22) Filed: Oct. 18, 2013

(65) Prior Publication Data

US 2014/0333487 A1 Nov. 13, 2014

(30) Foreign Application Priority Data

May 9, 2013 (TW) ..... 102116592 A

(51) Int. Cl.

| | |
|---|---|
| ***H01Q 1/24*** | (2006.01) |
| ***H01Q 21/30*** | (2006.01) |
| ***H01Q 5/371*** | (2015.01) |
| *H01Q 7/00* | (2006.01) |
| *H01Q 9/30* | (2006.01) |

(52) U.S. Cl.

CPC ..... *H01Q 1/243* (2013.01); *H01Q 5/371* (2015.01); *H01Q 21/30* (2013.01); *H01Q 7/00* (2013.01); *H01Q 9/30* (2013.01)

(58) Field of Classification Search

CPC ..... H01Q 1/243; H01Q 5/371; H01Q 21/30; H01Q 7/00; H01Q 5/378; H01Q 9/0407

USPC ..... 343/702

See application file for complete search history.

(56) References Cited

U.S. PATENT DOCUMENTS

| | | | | |
|---|---|---|---|---|
| 2006/0208950 | A1* | 9/2006 | Tago | 343/702 |
| 2008/0165067 | A1* | 7/2008 | Kim | 343/702 |
| 2009/0256759 | A1* | 10/2009 | Hill et al. | 343/702 |
| 2011/0128190 | A1* | 6/2011 | Galeev | H01Q 1/243 343/702 |
| 2012/0256800 | A1* | 10/2012 | Kuonanoja | 343/749 |

* cited by examiner

*Primary Examiner* — Dameon E Levi
*Assistant Examiner* — Ricardo Magallanes
(74) *Attorney, Agent, or Firm* — Zhigang Ma

(57) ABSTRACT

An exemplary wireless communication device includes a circuit board, a first antenna, a second antenna, and an end portion. The circuit board includes a feed terminal. The first antenna is located on the circuit board adjacent to the feed terminal. The second antenna is electronically connected to the feed terminal. The end portion serves as a portion of a metal housing of the wireless communication device and includes a positioning portion. The positioning portion secures the first antenna and the end portion to the circuit board.

17 Claims, 4 Drawing Sheets

WIRELESS COMMUNICATION DEVICE

BACKGROUND

1. Technical Field

The disclosure generally relates to wireless communication devices, and particularly to a wireless communication device having a metal housing.

2. Description of Related Art

Wireless communication devices can include metal housings. A metal housing may constitute all or part of a casing of the wireless communication device. However, the metal housing may mask and interfere with signals transmitted by an antenna located in the wireless communication device, thus reducing a capability of the antenna.

Therefore, the antenna is integrated with the metal housing to use the metal housing as a radiating body to enhance the radiating capability of the antenna. This can be done by defining a slot in a surface of the metal housing so that the metal housing serves as a slot antenna. However, the metal housing may be damaged during formation of the slot, thereby diminishing an aesthetic appearance of the metal housing.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
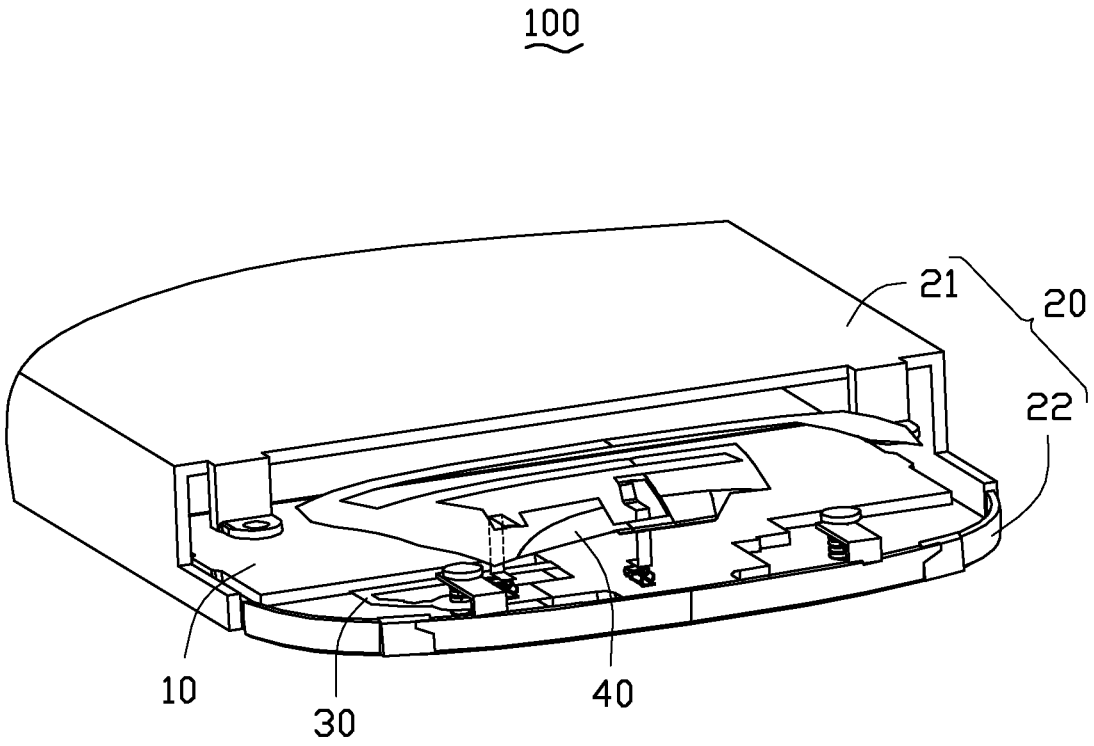
FIG. 1 is a schematic, isometric view of a wireless communication device, according to an exemplary embodiment.

FIG. 1 is a schematic, isometric view of a wireless communication device 100, according to an exemplary embodiment. The wireless communication device 100 may be a mobile phone or a personal digital assistant, for example. The wireless communication device 100 includes a circuit board 10, a housing 20, a first antenna 30, and a second antenna 40.

Figure 2:
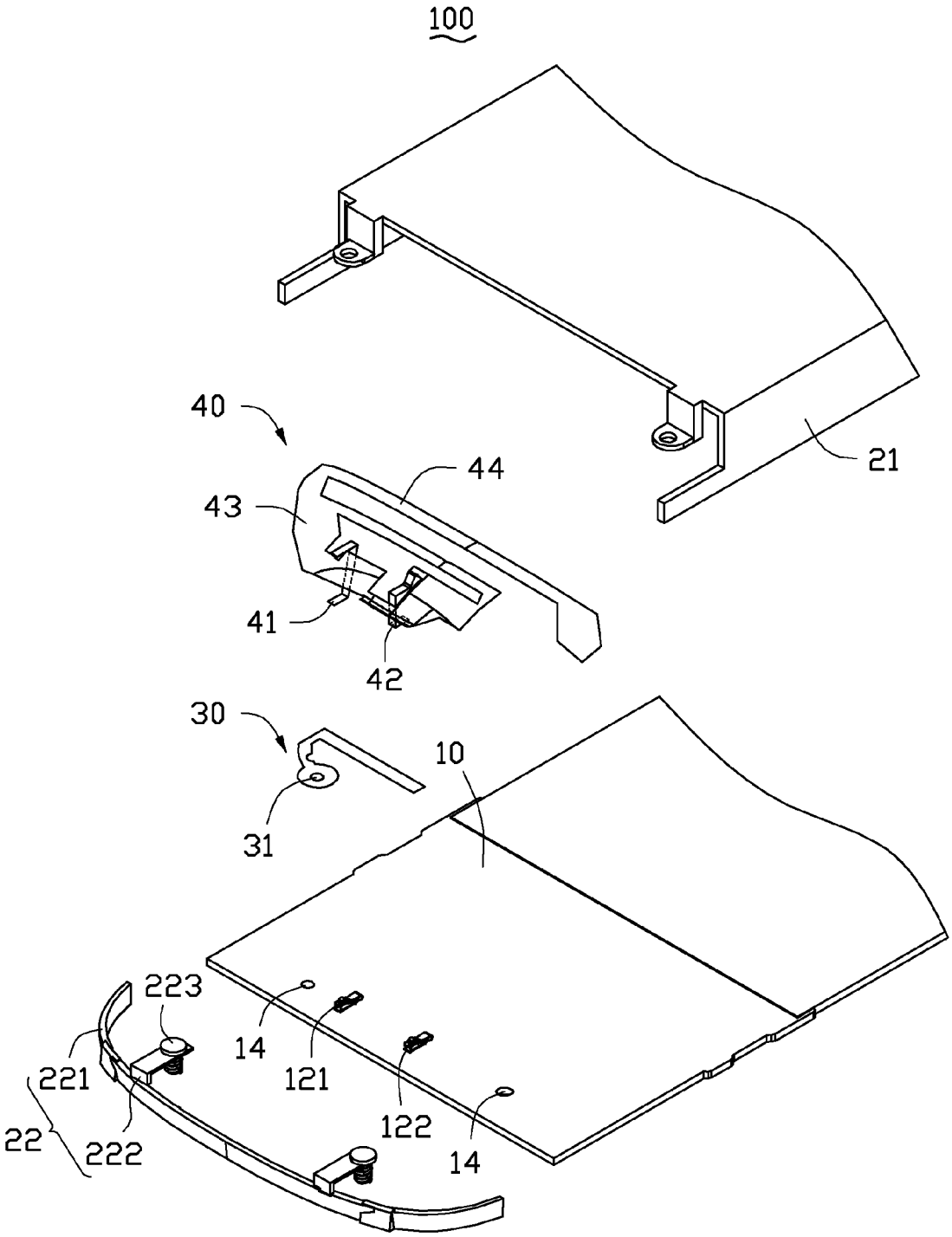
FIG. 2 is a partial exploded view of the wireless communication device shown in FIG. 1.

Referring to FIG. 2, the circuit board 10 is substantially a rectangular plate. A feed terminal 121 and a ground terminal 122 are located on the circuit board 10 and spaced from each other. The circuit board 10 defines at least one mounting hole 14. In the exemplary embodiment, there are two mounting holes 14. The circuit board 10 also includes electronic members (not shown), such as a speaker or a camera, to perform various functions of the wireless communication device 100.

The housing 20 includes a main body 21 and an end portion 22. The main body 21 is a portion of a casing of the wireless communication device 100, and covers the circuit board 10 (see FIG. 1). The main body 21 is secured to the circuit board 10 by screws. In other embodiments, the main body 21 can be secured to the circuit board 10 by any other suitable securing method. The end portion 22 includes a side wall 221 and two connecting arms 222. The side wall 221 is substantially arc-shaped. The side wall 221 is located at a side of the circuit board 10 and surrounds edges of the circuit board 10.

The connecting arms 222 are located at a same side of the side wall 221 and are spaced from each other. Each connecting arm 222 includes a positioning portion 223. The positioning portion 223 can be a metal member, such as a rivet or a screw, that is received in a through hole (e.g., the mounting hole 14). The positioning portions 223 are configured for securing the end portion 22 and the first antenna 30 to the circuit board 10.

The first antenna 30 is a monopole antenna. A positioning hole 31 is defined at an end of the first antenna 30. The positioning hole 31 is aligned with one of the mounting holes 14 adjacent to the feed terminal 121. When one of the positioning portions 223 is received in the positioning hole 31 and the mounting hole 14, the first antenna 30 is secured to the circuit board 10.

Figure 3:
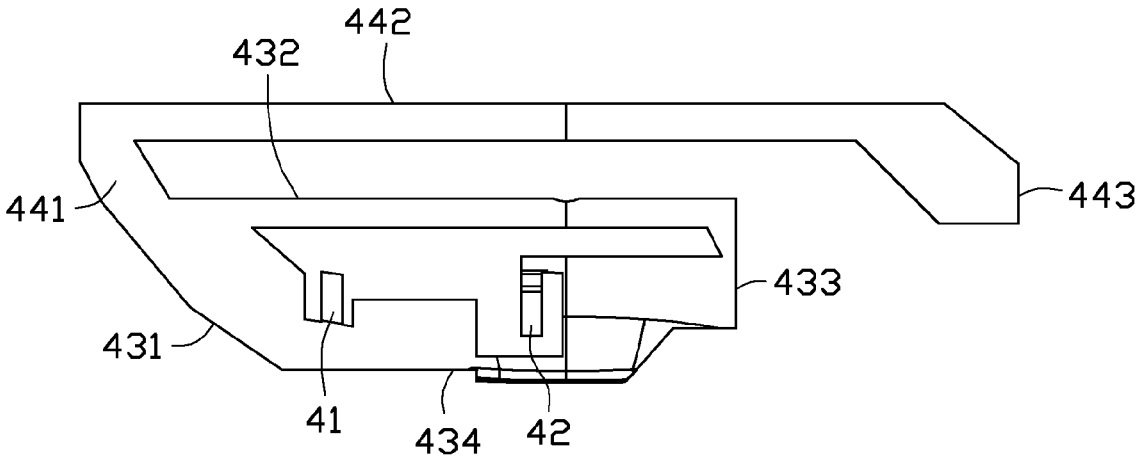
FIG. 3 is a schematic view of a second antenna of the wireless communication device shown in FIG. 1.

The second antenna 40 is located above the circuit board 10. Referring to FIG. 3, the second antenna 40 includes a feed portion 41, a ground portion 42, a first radiating body 43, and a second radiating body 44. The feed terminal 121 of the circuit board 10 is electronically connected to the feed portion 41 to feed current to the second antenna 40. The ground terminal 122 is electronically connected to the ground portion 42 of the circuit board 10 to provide ground for second antenna 40.

The first radiating body 43 is a loop structure and includes a first combining portion 431, a second combining portion 432, a third combining portion 433, and a fourth combining portion 434. In detail, the first combining portion 431 is electronically connected to the feed portion 41. The second combining portion 432 is connected to the first combining portion 431 and extends away from the first combining portion 431. The third combining portion 433 and the first combining portion 431 extend toward a same side of the second combining portion 432. The third combining portion 433 is electronically connected to an end of the second combining portion 432 away from the first combining portion 431. The third combining portion 433 is further connected to the ground portion 42. The fourth combining portion 434 is connected between the third combining portion 433 and the first combining portion 431. In one exemplary embodiment, a width of the second combining portion 432 is less than the widths of the first combining portion 431 and the third combining portion 433.

The second radiating body 44 includes a first connecting section 441, a second connecting section 442, and a third connecting section 443 connected in that order. The first connecting section 441 is connected to a junction of the first combining portion 431 and the second combining portion 432. The second connecting section 442 is connected to the first connecting section 441 and extends in a direction substantially parallel to the second combining portion 432 of the first radiating body 43. A length of the second connecting section 442 is greater than that of the second combining portion 432. The third connecting section 443 and the first connecting section 441 extend toward a same side of the second connecting section 442. The third connecting section 443 is connected to an end of the second connecting section 442 away from the first combining portion 441.

In assembly, one positioning portion 223 is received by the positioning hole 31 of the first antenna 30 and the mounting hole 14 adjacent to the feed terminal 121, thereby securing the first antenna 30 to the circuit board 10 and locating the end portion 22 at a side of the circuit board 10. The other positioning portion 223 is received by the other mounting hole 14 adjacent to the ground terminal 122 to ensure that the circuit board 10 is stable relative to the end portion 22. The second antenna 40 is located above the circuit board 10 such that the feed portion 41 is electronically connected to the feed terminal 121 and the ground portion 42 is electronically connected to the ground terminal 122. The main body 21 is secured to the circuit board 10 by screws.

When the wireless communication device 100 operates, current is fed from the feed terminal 121. Since the first antenna 30 is adjacent to the feed terminal 121, the current from the feed terminal 121 is coupled to the first antenna 30. Thus, the current flows through the first antenna 30, the positioning portion 223, the end portion 22 of the housing 20, and the second antenna 40 to form a plurality of current paths having different electrical lengths so as to achieve multiple frequency bands.

In detail, when the current couples to the first antenna 30, since the first antenna 30 is electronically connected to the end portion 22 by the positioning portion 223, the current also flows through the positioning portion 223 and the end portion 22 of the housing 20. Thus, the end portion 22 serves as a radiating body, and the first antenna 30 and the end portion 22 cooperatively resonate at a first frequency band having a central frequency of about 1748 megaHertz (MHz). Therefore, the wireless communication device 100 is operable at a Digital Cellular System 1800 (DCS1800) frequency band.

When the current flows through the feed portion 41 and the first radiating body 43, the first radiating body 43 resonates at a second frequency band having a central frequency of about 1880 MHz. Therefore, the wireless communication device 100 is operable at a Personal Communications Service 1900 (PCS1900) frequency band.

When the current flows through the feed portion 41, the first radiating body 43, and the second radiating body 44, the first radiating body 43 and the second radiating body 44 cooperatively resonate at a third frequency band having a central frequency of about 870 MHz. Therefore, the wireless communication device 100 is operable at a Global System for Mobile communications 850 (GSM850) frequency band and an Extended Global System for Mobile communications 900 (EGSM900) frequency band.

Figure 4:
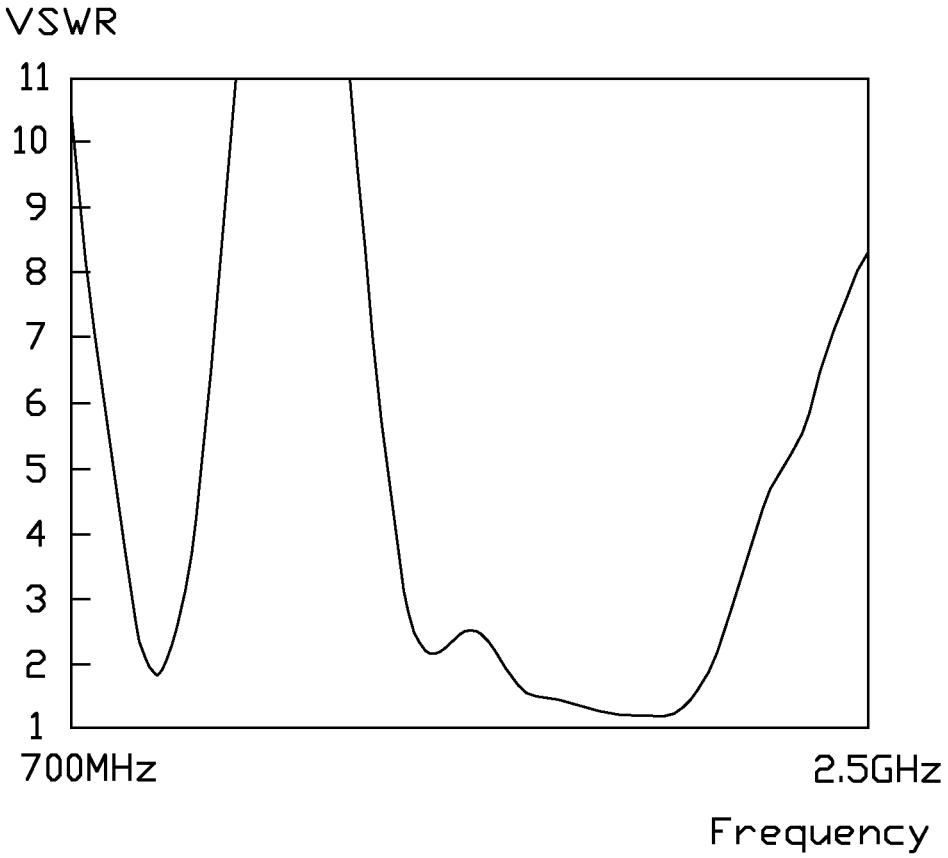
FIG. 4 is a graph showing a voltage standing wave ratio (VSWR) varying with frequency according to tests of the wireless communication device, according to an exemplary embodiment.

Referring to FIG. 4 and Table 1, according to test results, the wireless communication device 100 obtains a better signal radiating effect at multiple working frequency bands.

TABLE 1

Signal receiving and transmitting efficiency

| Frequency band | GSM850 | EGSM900 | DCS1800 | PCS1900 |
|---|---|---|---|---|
| Transmitting efficiency | 69.42%-77.33% | 68.20%-76.80 | 60.85%-65.39% | 60.85%-65.39% |
| Receiving efficiency | 74.33%-76.84% | 55.83%-65.58% | 58.27%-61.33% | 58.27%-61.33% |

The end portion 22 of the wireless communication device 100 is secured to the circuit board 10 by the positioning portions 223, and the positioning portion 223 is connected to the antenna 30. The end portion 22 serves as a radiating body for the antenna 30 to obtain multiple working frequency bands, so that the antenna 30 has a better radiating performance. In addition, no slot is defined in the main body 21. Thus, an aesthetic appearance of the wireless communication device 100 is effectively improved.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A wireless communication device, comprising:

a circuit board comprising a feed terminal;

a first antenna located on the circuit board adjacent to the feed terminal;

a second antenna electronically connected to the feed terminal and comprising a first radiating body, wherein the first radiating body is a loop structure and comprises a first combining portion, a second combining portion, a third combining portion, and a fourth combining portion, the second combining portion is connected to the first combining portion and extends away from the first combining portion, the third combining portion is electrically connected to an end of the second combining portion away from the first combining portion, one end of the fourth combining portion is electrically connected to an end of the third combining portion away from the second combining portion, the other end of the fourth combining portion is directly and electrically connected to the first combining portion; and an end portion serving as a portion of a metal housing of the wireless communication device, the end portion comprising a positioning portion; wherein the positioning portion secures the first antenna and the end portion to the circuit board, current from the feed terminal is coupled to the first antenna and flows through the positioning portion and the end portion to resonate at a first frequency, and the current from the feed terminal further directly flows through the second antenna to resonates at a second frequency.

2. The wireless communication device of claim 1, wherein a mounting hole is defined on the circuit board, a positioning hole is defined at an end of the first antenna, the positioning portion is received by the positioning hole and the mounting hole.

3. The wireless communication device of claim 1, wherein the end portion comprises a side wall and two connecting arms, the side wall surrounds edges of the circuit board, the connecting arms are located on the side wall and spaced from each other.

4. The wireless communication device of claim 3, wherein the positioning portion is located on one of the connecting arms.

5. The wireless communication device of claim 4, wherein the end portion further comprises another positioning portion, another mounting hole is defined on the circuit board, the another positioning portion is located on the other connecting arm and received by the another mounting hole.

6. The wireless communication device of claim 1, further comprising a ground terminal, wherein the second antenna is located above the circuit board, the second antenna comprises a feed portion and a ground portion, the feed portion is electronically connected to the feed terminal, the ground portion is electronically connected to the ground terminal.

7. The wireless communication device of claim 6, wherein the first combining portion is electronically connected to the feed portion, the third combining portion is electronically connected to the ground portion.

8. The wireless communication device of claim 1, wherein the second antenna further comprises a second radiating body, the second radiating body comprises a first connecting section, a second connecting section, and a third connecting section connected in that order, the first connecting section is connected to a junction of the first combining portion and the second combining portion; the second connecting section is connected to the first connecting section and extends in a direction parallel to the second combining portion; the third connecting section is connected to an end of the second connecting section away from the first combining portion.

9. A wireless communication device, comprising:

a circuit board comprising a feed terminal;

a first antenna located on the circuit board adjacent to the feed terminal;

a second antenna electronically connected to the feed terminal and comprising a first radiating body, wherein the first radiating body is a loop structure and comprises a first combining portion, a second combining portion, a third combining portion, and a fourth combining portion, the second combining portion is connected to the first combining portion and extends away from the first combining portion, the third combining portion is electrically connected to an end of the second combining portion away from the first combining portion, one end of the fourth combining portion is electrically connected to an end of the third combining portion away from the second combining portion, the other end of the fourth combining portion is directly and electrically connected to the first combining portion; and a housing comprising an end portion made of metal material, wherein the end portion comprises a positioning portion; the positioning portion secures the first antenna and the end portion to the circuit board, current from the feed terminal is coupled to the first antenna and flows through the positioning portion and the end portion to resonate at a first frequency, and the current from the feed terminal further directly flows through the second antenna to resonates at a second frequency.

10. The wireless communication device of claim 9, wherein a mounting hole is defined on the circuit board, a positioning hole is defined on a distal end of the first antenna, the positioning portion is received by the positioning hole and the mounting hole.

11. The wireless communication device of claim 9, wherein the end portion comprises a side wall and two connecting arms, the side wall surrounds edges of the circuit board, the connecting arms are located on the side wall and spaced from each other.

12. The wireless communication device of claim 11, wherein the positioning portion is located on one of the connecting arms.

13. The wireless communication device of claim 12, wherein the end portion further comprises another positioning portion, another mounting hole is defined on the circuit board, the another positioning portion is located on the other connecting arm and received by the another mounting hole.

14. The wireless communication device of claim 9, further comprising a ground terminal and a second antenna, wherein the second antenna is located above the circuit board, the second antenna comprises a feed portion and a ground portion, the feed portion is electronically connected to the feed terminal, the ground portion is electronically connected to the ground terminal.

15. The wireless communication device of claim 14, wherein the first combining portion is electronically connected to the feed portion, the third combining portion is electronically connected to the ground portion.

16. The wireless communication device of claim 9, wherein the second antenna further comprises a second radiating body, the second radiating body comprises a first connecting section, a second connecting section, and a third connecting section connected in that order, the first connecting section is connected to a junction of the first combining portion and the second combining portion; the second connecting section is connected to the first connecting section and extends in a direction parallel to the second combining portion; the third connecting section is connected to an end of the second connecting section away from the first combining portion.

17. A wireless communication device, comprising:

a circuit board comprising a feed terminal;

a first antenna located on the circuit board adjacent to the feed terminal;

a second antenna electronically connected to the feed terminal and comprising a first radiating body, wherein the first radiating body is a loop structure and comprises a first combining portion, a second combining portion, a third combining portion, and a fourth combining portion, the second combining portion is connected to the first combining portion and extends away from the first combining portion, the third combining portion is electrically connected to an end of the second combining portion away from the first combining portion, one end of the fourth combining portion is electrically connected to an end of the third combining portion away from the second combining portion, the other end of the fourth combining portion is directly and electrically connected to the first combining portion; and an end portion, the end portion serving as a portion of a metal housing of the wireless communication device and further serving as a radiating body of the first antenna; wherein the end portion comprises a positioning portion; the positioning portion secures the first antenna and the end portion to the circuit board, current from the feed terminal is coupled to the first antenna and flows through the positioning portion and the end portion to resonate at a first frequency, and the current from the feed terminal further directly flows through the second antenna to resonates at a second frequency.

* * * * *